US005085323A

United States Patent [19]

Kuchenbecker et al.

[11] Patent Number: 5,085,323

[45] Date of Patent: Feb. 4, 1992

[54] CARTON HAVING A PERFORATION CUT SCORE OPENING AND A CARTON BLANK FOR FORMING THE SAME

[75] Inventors: Morris W. Kuchenbecker; Raymond V. Maroszek, both of Neenah, Wis.

[73] Assignee: James River Corporation of Virginia, Richmond, Va.

[21] Appl. No.: 584,050

[22] Filed: Sep. 18, 1990

[51] Int. Cl.[5] ..... B65D 5/54

[52] U.S. Cl. ..... 229/207; 229/208; 229/232

[58] Field of Search ..... 206/607, 611, 625, 628, 206/612; 229/902, 903, 906

[56] References Cited

U.S. PATENT DOCUMENTS

| | | | |
|---|---|---|---|
| 2,974,852 | 3/1961 | Huss et al. . | |
| 3,167,238 | 1/1965 | Smith | 206/625 |
| 3,399,820 | 9/1968 | Foster et al. . | |
| 3,526,353 | 9/1970 | Jaeschke | 206/607 |
| 3,580,466 | 5/1971 | Thelen | 206/607 |
| 3,905,646 | 9/1975 | Brackmann et al. | 206/625 |
| 4,043,503 | 8/1977 | Meyers et al. | 206/625 |
| 4,613,046 | 9/1986 | Kuchenbecker . | |
| 4,687,104 | 8/1987 | Ieimini . | |
| 4,738,365 | 4/1988 | Prater | 206/625 |
| 4,746,019 | 5/1988 | Prater . | |
| 4,813,594 | 3/1989 | Brown et al. | 229/906 |
| 4,919,785 | 4/1990 | Willey et al. | 206/625 |
| 4,930,639 | 6/1990 | Rigby | 206/625 |
| 4,951,824 | 8/1990 | Kuchenbecker et al. . | |

*Primary Examiner*—Gary E. Elkins

*Attorney, Agent, or Firm*—Sixbey, Friedman, Leedom & Ferguson

[57] ABSTRACT

A paperboard carton is disclosed which is constructed from a paperboard blank including a first panel having side walls connected thereto by scored fold lines formed between a respective side wall and a respective edge of the first panel. A second panel is provided having side walls connected thereto by scored fold lines formed between a respective side wall and a respective edge of the second panel with one of the side walls of the first panel and one of the side walls of the second panel being congruent. The second panel further includes an opening device formed therein for allowing access to the interior of a formed carton. This opening device includes a tab extending from an edge of the second panel, at least one through cut segment extending from an edge of the tab into the second panel of the blank and terminating at a termination point, at least one partially cut line of weakness formed in the second panel and at least one perforated line of weakness formed in the second panel and extending substantially parallel to the partially cut line of weakness, with the partially cut line of weakness having a portion which intersects the through cut segment extending from the edge of the tab at the termination point and the perforated line of weakness is colinear with the through cut segment and spaced a predetermined distance from the termination point of the through cut segment.

24 Claims, 4 Drawing Sheets

CARTON HAVING A PERFORATION CUT SCORE OPENING AND A CARTON BLANK FOR FORMING THE SAME

BACKGROUND OF THE INVENTION

1. Technical Field

The present invention relates to a carton blank for forming a carton, and a carton which is to be filled with a consumable product accessible through an opening in the carton. More particularly, the invention pertains to an opening feature formed in a top panel of the carton which provides a reliable and a consistent opening when opened by the consumer.

2. Background Art

Paperboard cartons have been manufactured with a variety of opening features which allow the consumer access to the contents of the cartons. These features may consist of perforations, herringbone cuts, adhesive weaknesses, as well as other means of providing a point along the top panel, side panel or hinge lines where the carton may be most readily opened. A further opening feature commonly employed in cartons of this type is that of double-cut scores, as shown in U.S. Pat. No. 3,399,820 to Foster et al.

The above-mentioned opening feature is formed by way of double-cut scores; i.e., an inner and outer cut in the paperboard which run parallel to one another. By so providing these cut score lines, when the consumer applies an upward force or opening force on the pull tab provided between the pairs of cut score lines, ply separation occurs in the regions between the inner and outer cut score lines. Continued pulling of the pull tab causes complete separation of the opening flap to allow the consumer unobstructed access to the contents of the carton.

Similar opening features are disclosed in U.S. Pat. No. 4,746,109 to Prater and U.S. Pat. No. 4,613,046 to Kuchenbecker. As in the above-mentioned patent, a line of weakness is provided in a panel of a respective carton where ply separation of the panel is permitted to occur when the consumer applies an opening force to the pull tab. The ply separation occurs between two pairs of reverse cut lines which are formed at least halfway through the panel of the carton. However, when forming the paperboard blanks which are to be later used in erecting the cartons disclosed, it is extremely difficult to accurately achieve the desired extent of the cut lines in both the top and bottom cut. These paperboard blanks are formed in a matrix which consists of a plurality of forming dies and counters. Because the paperboard must be cut on both sides thereof to form the double or reverse cuts, an extensive alignment procedure must be undertaken to assure that each cut formed in each side of each paperboard blank of the matrix is properly formed.

U.S. Pat. No. 4,687,104 to Ielmini discloses a similar carton and carton blank having score lines formed in the outer and inner surfaces of the top and the front flap. These score lines are referred to as extending partially through the outer and inner surfaces of the carton and carton blank. Given this assertion, the carton formed by the reverse score lines of U.S. Pat. No. 4,687,104 is no more reliable than the cartons set forth above. These cartons, as explained above, are difficult to manufacture due to variations in the depths of the die cut score lines which are experienced during their formation and which are difficult to control. Consequently, the resulting carton will not open as prescribed.

U.S. Pat. No. 2,974,852 issued to Huss et al. discloses a top panel opening feature which includes a continuous perforation line which is encircled by a cut score line. This allows the encircled portion of the top panel to be completely removed from the carton thus permitting access to the contents of the carton. The top panel is pressed downwardly in order to randomly rupture the line of weakness about the opening portion and, consequently, the ply separation of the top panel of the carton may not reliably occur in a specified area; and, moreover, the ply separation may, in fact, never commence resulting in tears in the top panel.

In an attempt to overcome the shortcomings associated with the foregoing prior art, U.S. Pat. No. 4,951,824 issued to Kuchenbecker et al., the disclosure of which is hereby incorporated herein by reference, discloses a carton having a reliable opening feature for use in containers wherein it is imperative that the carton remain impervious to moisture or other environmental effects. The opening feature includes an uncut line of weakness extending substantially parallel to a partially cut line of weakness with each of the lines of weakness being formed from the same side of the carton blank. However, the ply separation is initiated at the fold line of the front flap which may result in a misdirection of the ply separation.

As can be seen from the foregoing, there is clearly a pressing need for a carton of the above-mentioned type which will provide a reliable, and consistent opening feature that is capable of being opened with ease by the consumer, and which will not retard the structural integrity of the carton when opened.

SUMMARY OF THE INVENTION

It is an object of the subject invention to overcome the deficiencies of the prior art. In particular, it is an object of the present invention to provide a carton having a reliable opening feature which is capable of opening smoothly without retarding the structural integrity of the carton.

It is another object of the subject invention to provide a paperboard blank for forming a carton having an opening feature wherein all the cut and score lines of the paperboard blank may be readily controlled during the manufacture of the paperboard blank.

Yet another object of the present invention is to provide a carton in which the consumer may heat or cook the contents while in the carton, as well as consume the food contained therein directly from the carton. The consumer is then capable of readily gaining access to the contents of the carton without destroying its structural integrity.

A further object of the present invention is to provide a reliable opening feature wherein during the opening of the carton, a stress concentration is formed at predetermined points in the top panel so as to initiate the delamination of the paperboard at those predetermined points and produce uniform delamination along the top panel of the carton.

These, as well as various additional objects and advantages of the subject invention are achieved by producing a paperboard carton blank including a first panel having side walls connected thereto by scored fold lines formed between a respective side wall and a respective edge of the first panel. A second panel is provided having side walls connected thereto by scored fold lines formed between a respective side wall and a respective edge of the second panel with one of the side walls of the first panel and one of the side walls of the second panel being congruent. A respective one of the panels further includes an opening means formed therein for allowing access to the interior of a formed, filled and sealed carton. This opening means includes a tab extending from an edge of the respective panel, at least one through cut segment extending from an edge of the tab into the respective panel of the blank and terminating at a termination point, at least one partially cut line of weakness formed in the respective panel and at least one perforated line of weakness formed in the respective panel and extending substantially parallel to the partially cut line of weakness, with the partially cut line of weakness having a portion which intersects with the through cut segment extending from the edge of the tab at the termination point and the perforated line of weakness is positioned to be colinear with the through cut segment and spaced a predetermined distance from the termination point of the through cut segment. A stress concentration is thereby formed at the intersection of the through cut segment and the partially cut line of weakness so as to insure initiation of ply separation between the lines of weakness upon opening by the consumer.

This carton blank is then used to form a paperboard carton having an opening feature which allows ready access to the contents of the carton. The opening feature preferably includes a pair of opening means which cooperate to form an opening flap when desired. Each pair of opening means includes one partially cut line of weakness and one perforated line of weakness with each being formed from the same side of the paperboard blank during manufacturing and extending from a respective termination point. Additionally, each of the respective partially cut lines of weakness will intersect a respective through cut segment extending from a respective edge of the tab thus forming two points of stress concentration which create a reliable initiation point for the respective ply separations.

Additional advantages of the subject invention will become apparent from the figures and the following description of the preferred embodiment.

DETAILED DESCRIPTION OF THE PREFERRED EMBODIMENTS

Figure 1:
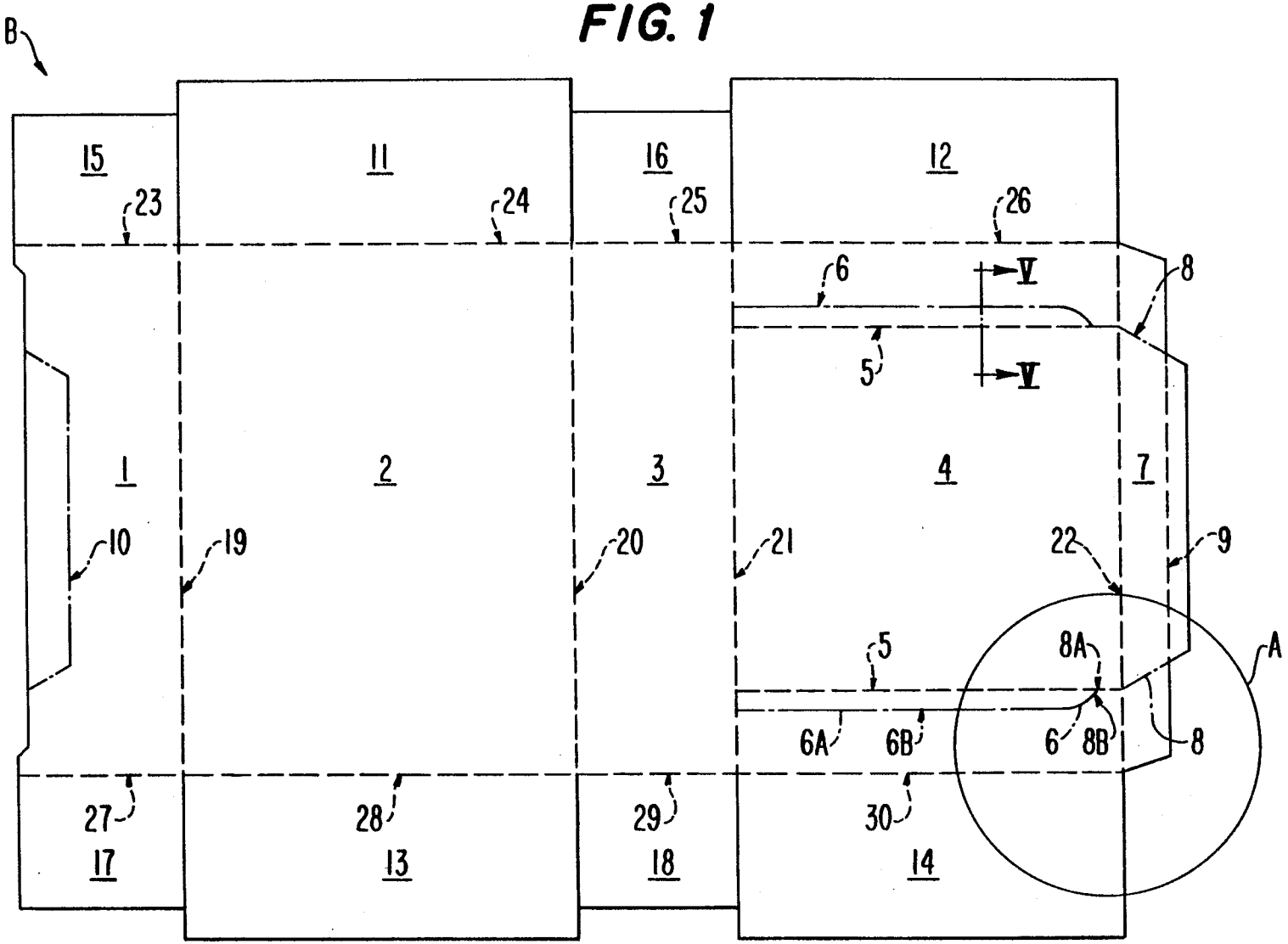
FIG. 1 is a top view of the paperboard carton blank used in forming the carton in accordance with a preferred embodiment of the invention.
Figure 2:
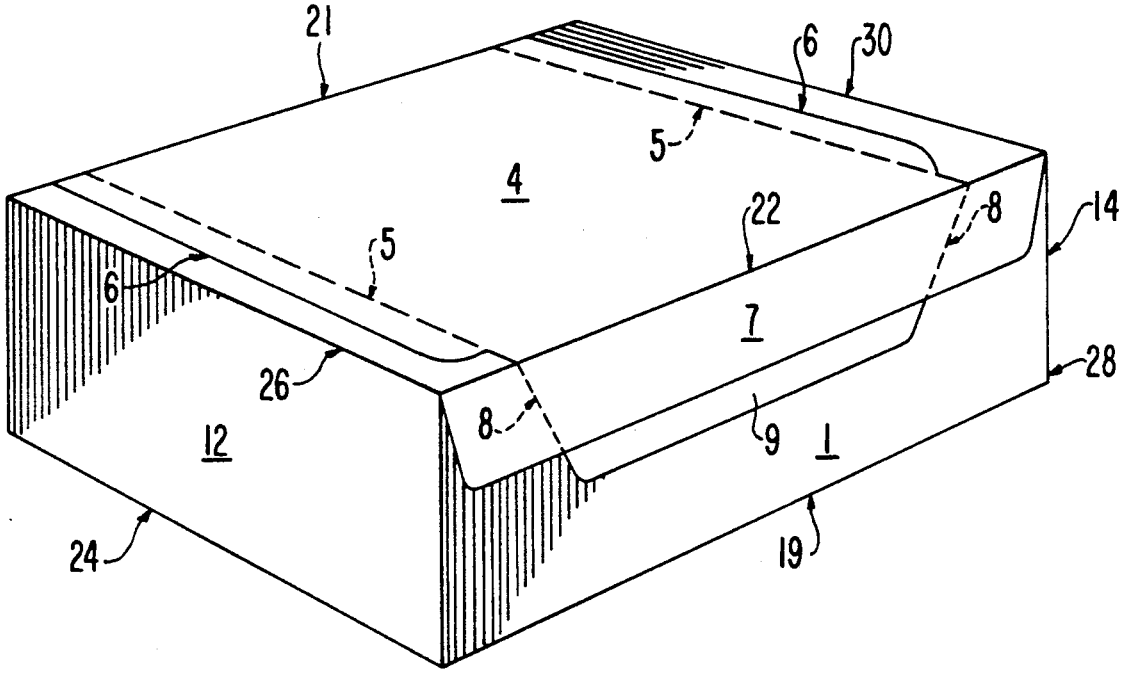
FIG. 2 is a perspective view of the paperboard carton in accordance with the preferred embodiment of the invention with the carton in its closed condition.

Referring now to FIG. 1, there is shown a carton blank for forming the carton set forth in FIG. 2. The carton blank B of FIG. 1 comprises a front panel 1, a bottom panel 2, a back panel 3 and a top panel 4. Like numerals will be used to designate like parts in each of the figures illustrated. The bottom panel 2 is flanked on either side by side walls 11 and 13 while top panel 4 is flanked on either side by side walls 12 and 14. The front panel 1 and rear panel 3 are likewise flanked by side walls 15 and 17, 16 and 18, respectively, which when constructed cooperate to form the end closures of the finished carton. The carton blank B is formed of a paperboard material. This paperboard material may be coated with polyethylene or other similar barrier materials. These materials may also be chosen to be suitable for use in a microwave oven. Those skilled in the art will certainly appreciate that the specific coating selected will depend directly on the intended use of the resulting carton.

Each of the panels 1, 2, 3 and 4 and the side walls 11–18 are hingedly connected to one another by way of score lines 19–30. By providing such score lines, the carton blanks can be readily formed into the carton illustrated in FIG. 2. Hingedly connected to the top panel 4 by way of score line 22 is a tear flap 7. The tear flap 7 additionally induces a lift tab 9 which may be readily grasped and drawn upward by the consumer to break away the tear flap 7 at the release area 10. The release area 10 is provided by forming a cut score line in the front panel 1 which allows a ply separation to occur in the release area 10 due to the pulling action of the consumer. The release area 10 allows the tear flap 7 to break away at the through cut lines 8. The through cut lines 8 being periodically interrupted along their length to maintain the flap 7 coplanar with the remainder of flap. This feature will be further discussed below with regard to the open containers.

Figure 5:
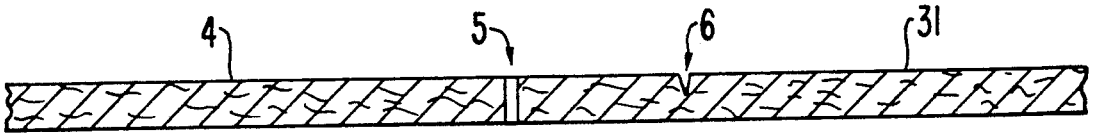
FIG. 5 is a cross-section view of the region of weakness taken along lines V—V of FIG. 1.

Illustrated in FIG. 1 is a pair of inwardly tapering perforated lines of weakness 5 which are positioned inward of and parallel to partially cut lines of weakness 6. As is illustrated in FIG. 5, the partially cut line of weakness 6 is cut into an upper or outer surface 31 of the top panel 4. The partially cut line of weakness 6 can be cut 5% to 85% of the way through the thickness of the top panel; however, a depth of approximately one-half of the thickness of the paperboard is preferred. The partially cut line of weakness being similar to those discussed in the prior art above. The perforated line of weakness 5 is also formed in the upper surface or outer surface 31 of the top panel 4 and thus forms the inner line of weakness of the finished carton. As can be seen from FIG. 5, the perforated line of weakness 5 extends entirely through the paperboard material.

Referring now to the encircled area A of FIG. 1, the through cut lines 8 in flap 7 abut one side of the fold line 22 but do not extend through the fold line 22. Through cut segments 8A in panel 4 abut the opposing side of the fold line 22 and terminate at a termination point 8B. The partially cut line of weakness 6 includes a portion 6A which extends substantially parallel to the perforated lines of weakness 5 and a portion 6B which is directed toward the through cut segment 8A and intersects at the termination point 8B. Also, it should be noted that the perforated line of weakness 5 is spaced apart from the termination point 8B. This feature is best shown with reference to FIG. 4.

Figure 4:
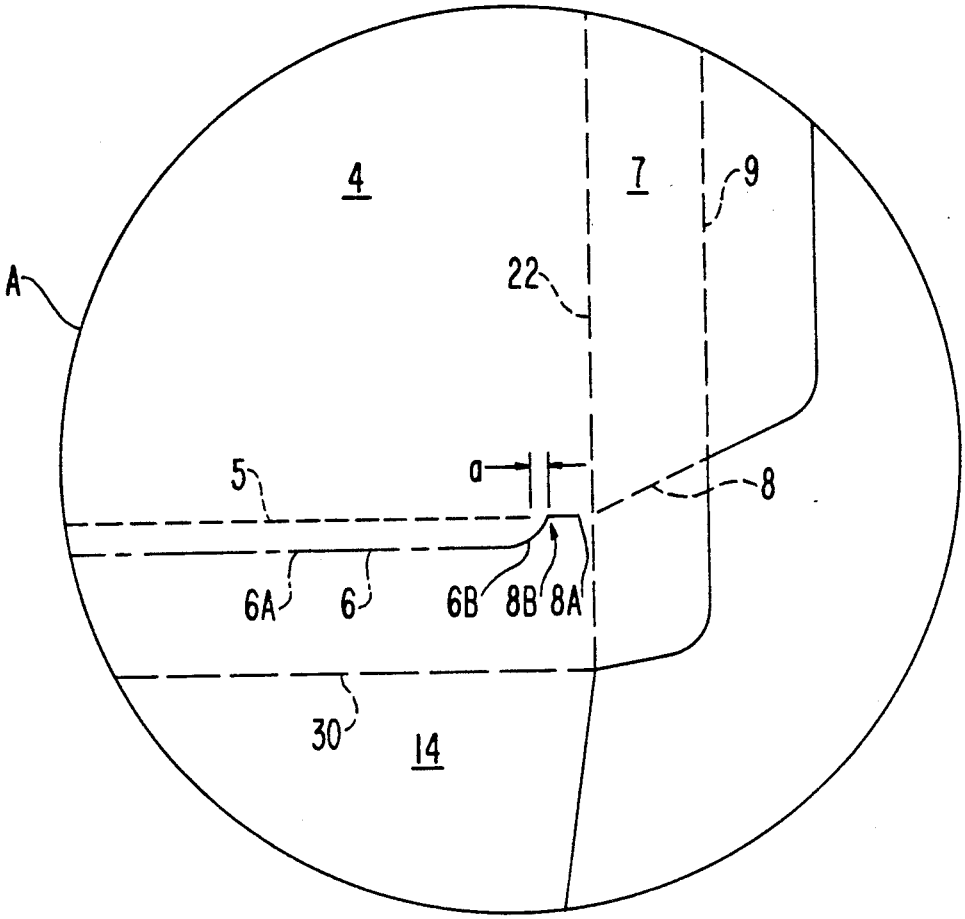
FIG. 4 is an expanded view of the portion A of FIG. 1.

FIG. 4 is an exploded illustration of the encircled portion A of FIG. 1. As can be readily seen from this figure, the portion 6B of the partially cut line of weakness 6 intersects the through cut segment 8A at the termination point 8B. Also, the perforated line of weakness is substantially colinear with the through cut segment 8A and is spaced a predetermined distance a from the termination point 8B. In doing so, a stress concentration is formed at the intersection of the through cut segment 8A and the portion 6B of the partially cut line of weakness 6, thus insuring the initiation of ply separation between the lines of weakness upon the assertion of an opening force being applied to the lift tab 9. While, in accordance with the preferred embodiment of the invention, the portion 6B of the partially cut line of weakness 6 intersects the through cut segment 8A at the termination point 8B, the portion 6B may end adjacent to the termination point 8B and still form the requisite stress concentration in order to reliably initiate the ply separation. The through cut segment 8A thus displaces the point of ply separation initiation away from the fold line 22.

The distance a will be directly dependent upon the size and type of carton manufactured as well as the caliper of the paperboard material. For example, with a carton having a top panel 2¾ inches by 4½ inches and a paperboard caliper of 0.028 inches, the distance a would be approximately 1/16 inches.

Turning now to FIG. 2, the carton blank is illustrated in its erect condition and has been preferably filled prior to the final sealing of either the end flaps or the top panel forming the finished product. As can be noted, the carton of FIG. 2 includes a pair of weakness regions formed by the perforated lines of weakness 5 and the partially cut lines of weakness 6. However, only a single region of weakness may be formed by the perforated line of weakness 5 and the partially cut line of weakness 6, while using the fold line 26 as the hinge line for the opening of the top panel 4. Further, with reference to FIG. 2, the regions of weakness extend from the front edge 22 of the top panel 4 to the rear edge 21 of the top panel 4. Also, while not illustrated, it should be noted that the regions of weakness shown in FIG. 2 may converge towards one another from the front edge 22 to the rear edge 21 of the top panel 4. In doing so, this inward taper continuously causes stress concentrations at the regions of weakness during the opening of the carton. This results in the uniform ply separation between the perforated lines of weakness 5 and the partially cut lines of weakness 6 such that the resultant carton opens evenly and cleanly at the predetermined region of weakness. Such being more specifically set forth in U.S. Pat. No. 4,951,824 referred to above.

Figure 3:
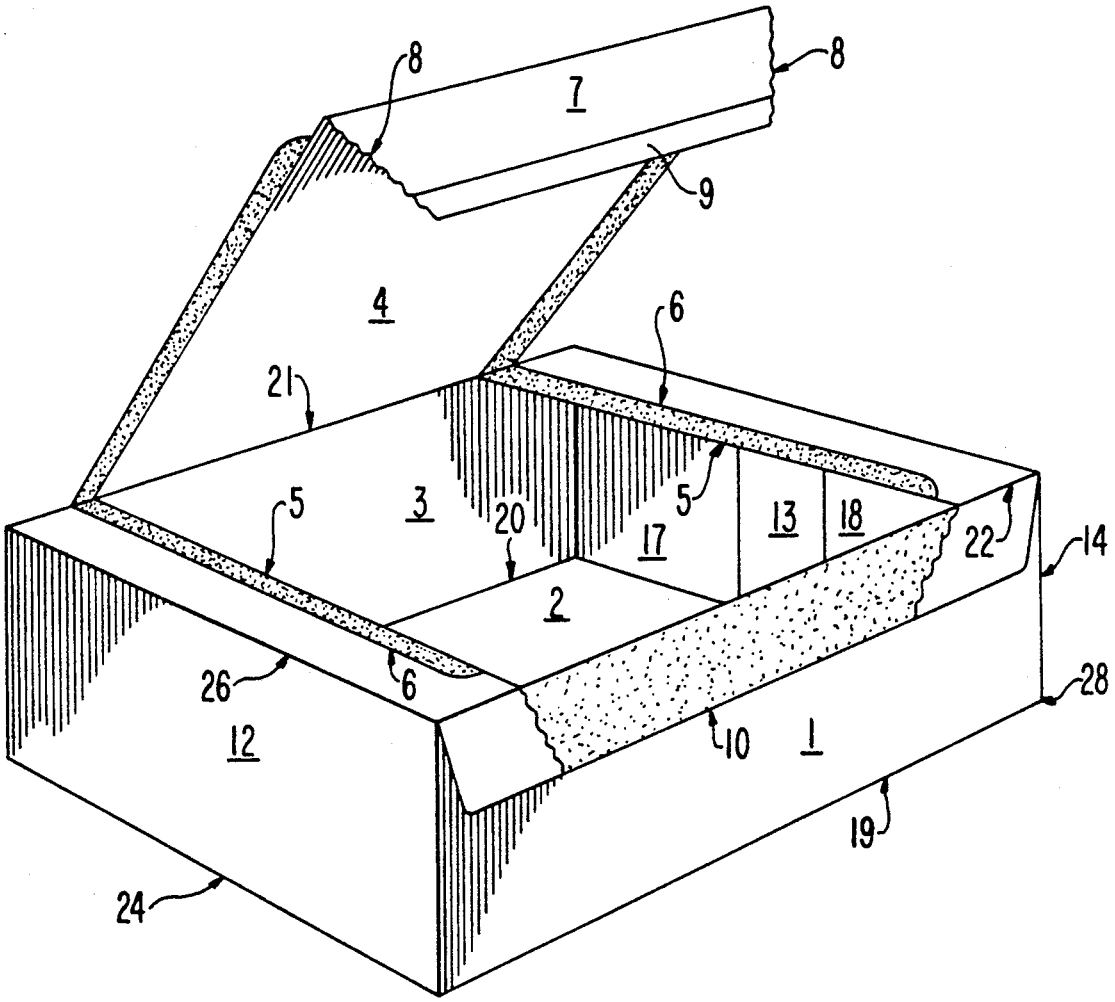
FIG. 3 is a perspective view of the carton of FIG. 2 in its open condition.

As mentioned above, to open the container the user Will grasp the lift tab 9 and pull upwardly thereon, at which time the through cut lines 8 will tear at its interruptions and a cut scored release area 10 will ply separate thereby releasing the tear flap 7. Once this is accomplished a continued upward force on the lift tab 9 by the consumer will cause ply separation between the lines of weakness 5 and 6 of the carton which will allow the consumer to open the carton as illustrated in FIG. 3. The lead in through cut segment 8A eliminates the need for the line of weakness 5 and 6 to with fold line 22, thus displacing the initiation point of ply separation away from the fold line 22. This allows the paperboard blanks to be easily formed during the die cut manufacturing operation.

While the invention has been described in connection with a carton of the above-mentioned type, the disclosed opening feature may be presented on any type carton where it is desired to have an opening mechanism which allows ready access to the contents of the carton. Further, the panels and side walls of the present invention may take any configuration and that configuration disclosed is only exemplary of the application of the opening feature of the present invention.

The foregoing is a description of illustrative embodiments of the invention, and those skilled in the art will appreciate that numerous modifications may be made of the invention without departing from its spirit. Therefore, it is intended that the scope of the invention be determined by the appended claims and their equivalents.

INDUSTRIAL APPLICABILITY

The above described opening feature may be incorporated in any paperboard type carton wherein it is desired to provide a mechanism for gaining easy access to the contents of a carton. Further, the regions of weakness formed in accordance with the present invention may be formed in any paperboard type blank where it is desired to form a smooth line of separation within the paperboard blank.

We claim:

1. An opening device formed in a panel of a paperboard carton for facilitating the formation of an opening in said carton comprising:

an opening force receiving means adjacent said panel;

at least one through cut segment formed in an outer surface of said panel extending from an edge of said opening force receiving means and into said panel to a termination point;

at least one perforated line of weakness extending substantially colinear with said through cut segment and spaced a predetermined distance from said termination point of said through cut segment; and at least one partially cut line of weakness formed in said outer surface of said panel, said partially cut line of weakness having a major portion extending substantially parallel to said perforated line of weakness and a minor portion which extends from said major portion toward said through cut segment substantially at said termination point forming an initiation point of a ply separation in said panel between said perforated line of weakness and said partially cut line of weakness;

wherein the ply separation of said paperboard carton occurs at a region of weakness between said perforated line of weakness and said partially cut line of weakness when an opening force is applied to said opening force receiving means.

2. The opening device as defined in claim 1, wherein said panel includes first and second side edges, a front edge and a rear edge and said opening force receiving means is a lift tab which extends from said front edge of said panel.

3. The opening device as defined in claim 2, wherein a pair of through cut segments, a pair of perforated lines of weakness and a pair of partially cut lines of weakness are provided forming a pair of substantially parallel regions of weakness, with said perforated lines of weakness being positioned between said partially cut lines of weakness.

4. The opening device as defined in claim 3, wherein said through cut segments extend from adjacent said front edge of said panel to respective points of termination and said respective regions of weakness extend from respective points of termination to the rear edge of said panel.

5. The opening device as defined in claim 1, wherein said perforated line of weakness is cut through the entire thickness of the paperboard material.

6. The opening device as defined in claim 1, wherein said partially cut line of weakness is cut 5% to 85% of the way through a thickness of the paperboard material.

7. The opening device as defined in claim 6, wherein said partially cut line of weakness is cut approximately 50% of the way through the paperboard material.

8. The opening device as defined in claim 1, wherein said minor portion of said partially cut line of weakness intersects said through cut segment substantially at said termination point.

9. A carton blank formed of a paperboard material for forming a paperboard carton comprising:

a first panel having side walls connected respective one of said side walls and a respective edge said first panel;

a second panel having side walls connected thereto by scored fold lines formed between a respective one of said side walls and a respective edge of said of said second panel, one of said side walls of said first panel and one of said side walls of said second panel being congruent; and an opening means formed in one of said panels for permitting access to the inside of a formed carton, said opening means including;

an opening force receiving means adjacent one of said panels;

at least one through cut segment formed in said one of said panels extending from an edge of said opening force receiving means and into said one of said panels to a termination point in said one of said panels;

at least one perforated line of weakness formed in said one of said panels extending substantially colinear with said through cut segment and spaced a predetermined distance from said termination point of said through cut segment; and at least one partially cut line of weakness formed in an outer surface of said one of said panels, said partially cut line of weakness having a major portion extending substantially parallel to said perforated line of weakness and a minor portion which extends from said major portion toward said through cut segment substantially at said termination point forming an initiation point of a ply separation in said one of said panels between said perforated line of weakness and said partially cut line of weakness;

wherein the initiation of ply separation of said paperboard material which occurs at a region of weakness between said perforated line of weakness and said partially cut line of weakness when an opening force is applied to said opening force receiving means is displaced away from the edge of said one of said panels.

10. The carton blank as defined in claim 9, wherein the respective edges of said one of said panels are first and second side edges, a front edge and a rear edge and said open force receiving means is a lift tab which extends from said front edge of said one of said panel.

11. The carton blank as defined in claim 10, wherein a pair of through cut segments, a pair of perforated lines of weakness and a pair of partially cut lines of weakness are provided forming a pair of substantially parallel regions of weakness, with said perforated line of weakness being positioned between said partially cut lines of weakness.

12. The carton blank as defined in claim 11, wherein said through cut segments extend from said front edge of said one of said panels and said respective regions of weakness extend from respective points of termination to the rear edge of said one of said panel.

13. The carton blank as defined in claim 9, wherein said perforated line of weakness is cut through the entire thickness of the paperboard material.

14. The carton blank as defined in claim 9, wherein said partially cut line of weakness is cut 5% to 85% of the way through a thickness of the paperboard material.

15. The carton blank as defined in claim 14, wherein said partially cut line of weakness is cut approximately 50% of the way through the paperboard material.

16. The carton blank as defined in claim 9, wherein said minor portion of said partially cut line of weakness intersects said through cut segment substantially at said termination point.

17. A carton formed of a paperboard material for containing a product placed therein comprising:

a top wall;

a bottom wall;

a plurality of side walls extending from said top wall to said bottom wall; and an opening means formed in one of said Walls for permitting access to the product within said carton, said opening means including;

an opening force receiving means adjacent said one of said walls;

at least one through cut segment formed in said one of said walls extending from an edge of said opening force receiving means and into said one of said walls to a termination point in said one of said walls;

at least one perforated line of weakness extending substantially colinear with said through cut segment and spaced a predetermined distance from said termination point of said through cut segment; and at least one partially cut line of weakness formed in an outer surface of said one of said walls, said partially cut line of weakness having a major portion extending substantially parallel to said perforated line of weakness and a minor portion which extends from said major portion towards said through cut segment substantially at said termination point forming an initiation point of a ply separation in said one of said walls between said perforated line of weakness and said partially cut line of weakness;

wherein the initiation of ply separation of said paperboard material which occurs at a region of weakness between said perforated line of weakness and said partially cut line of weakness when an opening force is applied to said opening force receiving means is displaced away from an edge of said one of said walls.

18. The carton as defined in claim 17, wherein said one of said walls includes first and second side edges, a front edge and a rear edge and said open force receiving means is a lift tab which extends from said front edge of said one of said panel.

19. The carton as defined in claim 18, wherein a pair of through cut segments, a pair of perforated lines of weakness and a pair of partially cut lines of weakness are provided forming a pair of substantially parallel regions of weakness, with said perforated line of weakness being positioned between said partially cut lines of weakness.

20. The carton as defined in claim 19, wherein said through cut segments extends from said front edge of said one of said walls and said respective regions of weakness extend from respective points of termination to the rear edge of said one of said panel.

21. The carton as defined in claim 17, wherein said perforated line of weakness is cut through the entire thickness of the paperboard material.

22. The carton as defined in claim 17, wherein said partially cut line of weakness is cut 5% to 85% of the way through a thickness of the paperboard material.

23. The carton as defined in claim 22, wherein said partially cut line of weakness is cut approximately 50% of the way through the paperboard material.

24. The carton as defined in claim 17, wherein said minor portion of said partially cut line of weakness intersects said through cut segment substantially at said termination point.

* * * * *

UNITED STATES PATENT AND TRADEMARK OFFICE

CERTIFICATE OF CORRECTION

PATENT NO. : 5,085,323

DATED : February 4, 1992

INVENTOR(S) : Morris W. Kuchenbecker; Raymond V. Maroszek

It is certified that error appears in the above-identified patent and that said Letters Patent is hereby corrected as shown below:

Column 7, Claim 9, line 3, after "connected" insert

--thereto by scored fold lines formed between a--

Signed and Sealed this

Seventh Day of September, 1993

Bruce Lehman

*Attest:*

BRUCE LEHMAN

*Attesting Officer*

*Commissioner of Patents and Trademarks*